US007356862B2

(12) United States Patent
Hsieh

(10) Patent No.: US 7,356,862 B2
(45) Date of Patent: Apr. 15, 2008

(54) WATERBED WITH MASSAGE FUNCTION

(76) Inventor: Yin-Pao Hsieh, 1F., No. 17, Lane 170, Hankou St., Pingjhen City, Taoyuan County 324 (TW)

( * ) Notice: Subject to any disclaimer, the term of this patent is extended or adjusted under 35 U.S.C. 154(b) by 435 days.

(21) Appl. No.: 11/194,004

(22) Filed: Jul. 28, 2005

(65) Prior Publication Data

US 2006/0107464 A1 May 25, 2006

(30) Foreign Application Priority Data

Nov. 25, 2004 (TW) ..... 93218914 U

(51) Int. Cl.
*A47C 27/08* (2006.01)

(52) U.S. Cl. ..... 5/674; 5/678; 5/665

(58) Field of Classification Search ..... 5/674, 5/678, 666, 665, 915, 108, 109; 601/48, 601/49, 51, 52, 55, 56, 59, 60
See application file for complete search history.

(56) References Cited

U.S. PATENT DOCUMENTS 3,085,568 A * 4/1963 Whitesell ..... 601/55
3,872,526 A * 3/1975 Betts ..... 5/674
4,048,684 A * 9/1977 Korner et al. ..... 5/674
4,088,124 A * 5/1978 Korner et al. ..... 600/22
4,105,024 A * 8/1978 Raffel ..... 601/59
4,114,215 A * 9/1978 Santo ..... 5/666
4,120,062 A * 10/1978 Anderson ..... 5/666
4,135,500 A * 1/1979 Gorran ..... 601/150
4,141,096 A * 2/1979 Hale et al. ..... 5/674
4,187,568 A * 2/1980 McMullan et al. ..... 5/674
4,231,126 A * 11/1980 Hurkett ..... 5/674
4,232,661 A * 11/1980 Christensen ..... 601/48
4,370,602 A * 1/1983 Jones et al. ..... 318/114
4,371,815 A * 2/1983 Jones et al. ..... 318/114
RE31,603 E * 6/1984 Christensen ..... 601/48
4,507,816 A * 4/1985 Smith, Jr. ..... 5/666
4,639,959 A * 2/1987 Roca ..... 5/674
4,667,358 A * 5/1987 Penterman ..... 5/674
4,757,548 A * 7/1988 Fenner, Jr. ..... 381/189
4,884,574 A * 12/1989 Hardie et al. ..... 601/55
4,947,832 A * 8/1990 Blitzer ..... 601/56
4,999,861 A * 3/1991 Huang ..... 5/600
5,092,315 A * 3/1992 Bennett et al. ..... 601/49
5,475,883 A * 12/1995 Martin ..... 5/674
5,695,455 A * 12/1997 Alton et al. ..... 601/47
5,862,550 A * 1/1999 Cosani ..... 5/612
5,953,773 A * 9/1999 Asada et al. ..... 5/81.1 R
6,491,717 B1 * 12/2002 Stanley et al. ..... 607/108
2006/0107464 A1 * 5/2006 Hsieh ..... 5/665

* cited by examiner

*Primary Examiner*—Robert G. Santos
(74) *Attorney, Agent, or Firm*—Pro-Techtor Int'l Services

(57) ABSTRACT

A waterbed includes a bed frame, a water mattress mounted on the bed frame, and a flapping device. The flapping device includes two longitudinal shafts rotatably supported by the bed frame and a plurality of flapping members securely mounted on each longitudinal shaft. The flapping members flap the water mattress when the longitudinal shafts turn, thereby creating water waves inside the water mattress. The user's body s can be massaged to obtain effects of exercise, fats removal, and weight losing.

13 Claims, 11 Drawing Sheets

WATERBED WITH MASSAGE FUNCTION

BACKGROUND OF THE INVENTION

1. Field of the Invention

The present invention relates to a waterbed. In particular, the present invention relates to a waterbed with a massage function.

2. Description of the Related Art

Due to excessive nutrition and lack of exercise, fat has become a common problem to modern people. To prevent from being too fat, moderate exercise is as necessary as diet. Various types of exercisers are thus popular on the market. The user has to move on the exercisers to consume calories and lose weight. However, no effect is obtained if the user lies still.

SUMMARY OF THE INVENTION

An objective of the present invention is to provide a water mattress with a massage function to massage the user's body such as the abdomen, arms, hips, legs, and breast, thereby providing exercising effect, removing fats, and losing weight.

In accordance with the present invention, a waterbed comprises a bed frame, a water mattress mounted on the bed frame, and a flapping device. The flapping device comprises two longitudinal shafts rotatably supported by the bed frame and a plurality of flapping members securely mounted on each longitudinal shaft. The flapping members flap the water mattress when the longitudinal shafts turn, thereby creating water waves inside the water mattress.

Preferably, the bed frame comprises two side boards each having a bottom section for supporting the water mattress.

Preferably, each side board has a front end section and a rear end section, and each longitudinal shaft is rotatably extended through the front end section and the rear end section of an associated one of the side boards.

Preferably, each flapping member comprises a central hole through which an associated one of the longitudinal shafts extends.

Preferably, each flapping member comprises at least one engaging protrusion in an end face thereof, and wherein each flapping member comprises at least one engaging notch on another end face thereof, allowing coupling of two adjacent flapping members.

Preferably, each flapping member comprises an eccentric protrusion for flapping the water mattress.

Preferably, two adjacent eccentric protrusions on the same longitudinal shaft extend in opposite directions.

Preferably, two of the eccentric protrusions that are respectively on the longitudinal shafts and that are at the same longitudinal position of the bed frame extend in opposite direction.

Preferably, each flapping member comprises at least one pair of supports mounted on an outer periphery thereof. A flapping roller is rotatably supported between each pair of supports.

Preferably, an outer ring is mounted around and actuatable by each flapping member. Each outer ring is fixed to the bed frame and includes an eccentric flapping section for flapping the water mattress.

Preferably, the water mattress comprises a plurality of isolated sections corresponding to the number of the flapping members on each longitudinal shaft.

Other objectives, advantages, and novel features of the invention will become more apparent from the following detailed description when taken in conjunction with the accompanying drawings.

DETAILED DESCRIPTION OF THE PREFERRED EMBODIMENTS

Figure 1:
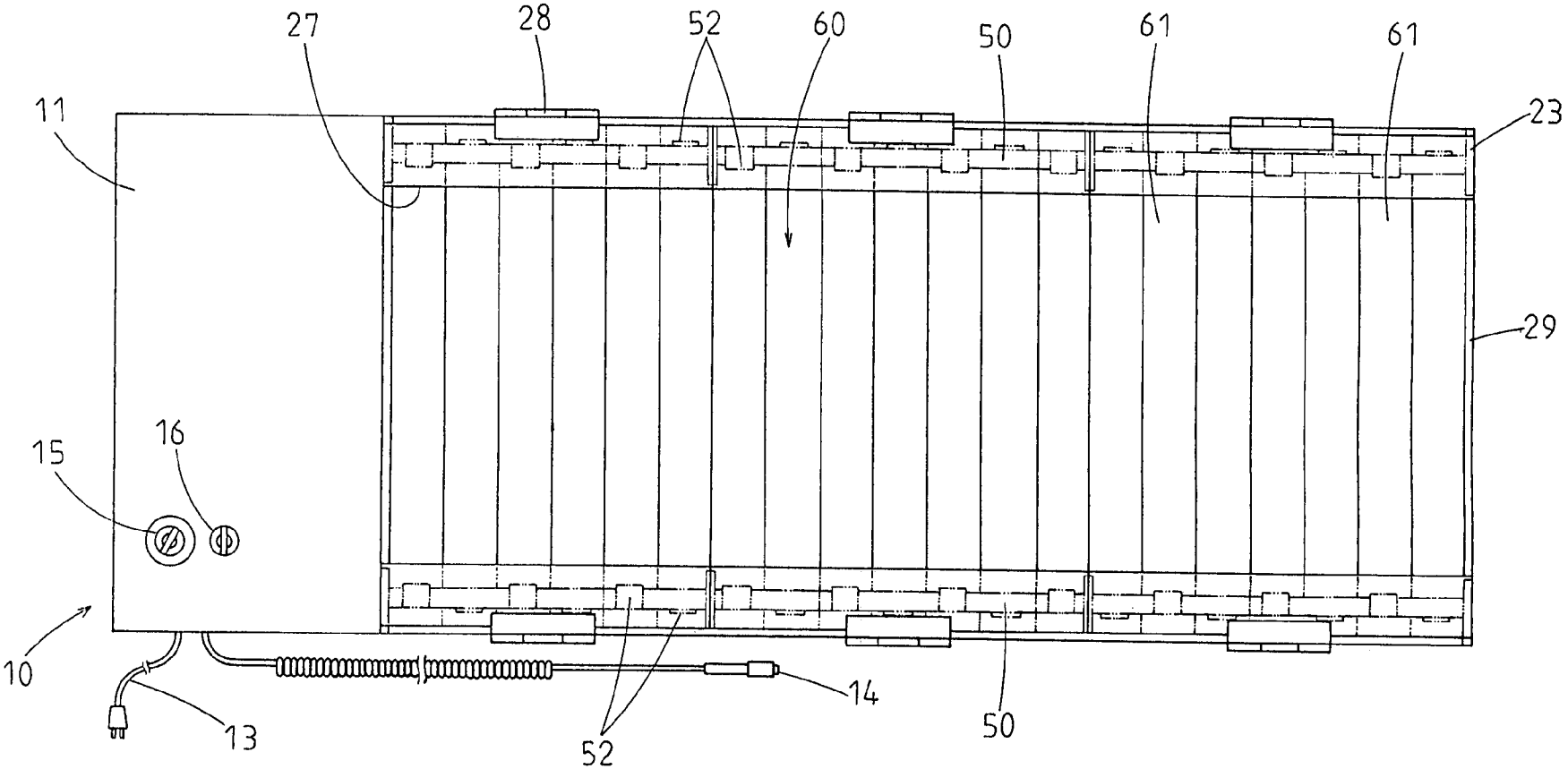
FIG. 1 is a top plane view of a waterbed in accordance with the present invention.

Referring to FIG. 1, a waterbed in accordance with the present invention comprises a bed frame, a water mattress 60, and a flapping device for flapping the water mattress 60 to create water waves for providing a massage effect. A control box 10 is provided to an end of the bed frame and includes a cover 11. Mounted in the control box 10 are a timer 15 and a speed changer 16 as well as other switches for controlling operation of the flapping device. A power line 13 and a power switch 14 are provided to control on/off of the flapping device.

The bed frame comprises two side boards 20 and 21 each having a bottom section 22, a front end section 23, and a rear end section 23, defining a space for accommodating the flapping device and a longitudinal shaft 40, 41. In the illustrate embodiment, a support beam 29 is connected between the rear end section 23 of the side board 20 and the rear end section 23 of the side board 21. A plurality of longitudinally spaced supports 26 are formed on an inner face of each side board 20, 21 to define a plurality of compartments that are respectively housed by lids 27 hinged to the side boards 20 and 21 (see hinges 28).

A motor 30 and a transverse shaft 34 are mounted in the control box 10. The transverse shaft 34 is driven by the motor 30 via a belt pulley 31 mounted on an output shaft (not labeled) of the motor 30, a belt pulley 33 mounted on the transverse shaft 34, and a belt 32 wound around the belt pulleys 31 and 33. A gear 35, 36 is mounted on each of two ends of the transverse shaft 34 and meshes with a transmission gear 42, 43 on an associated one of the longitudinal shafts 40 and 41. Thus, the shafts 40 and 41 are turned when the motor 30 is turned on.

Figure 2:
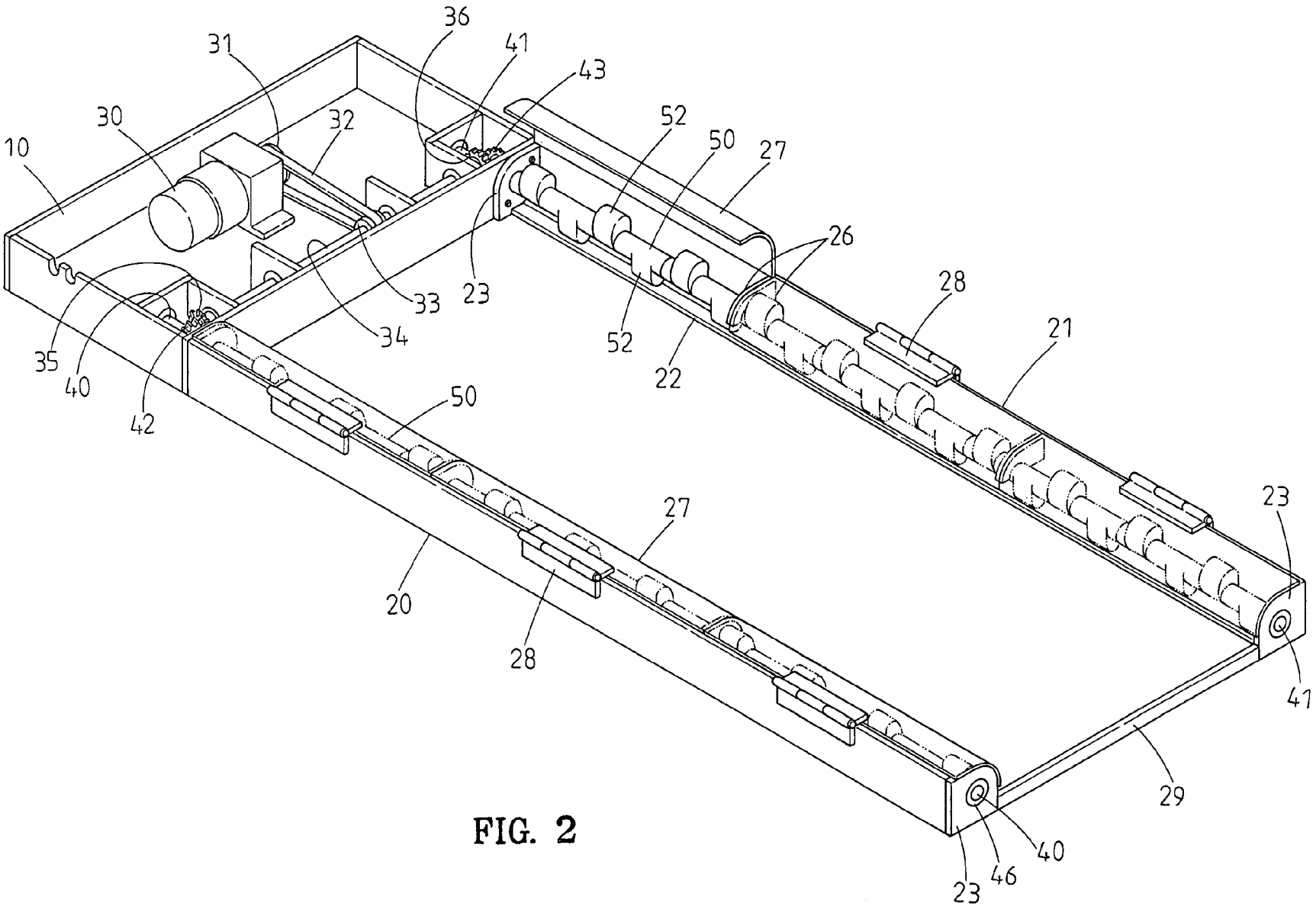
FIG. 2 is a top perspective view of a main structure of the water mattress in accordance with the present invention.
Figure 3:
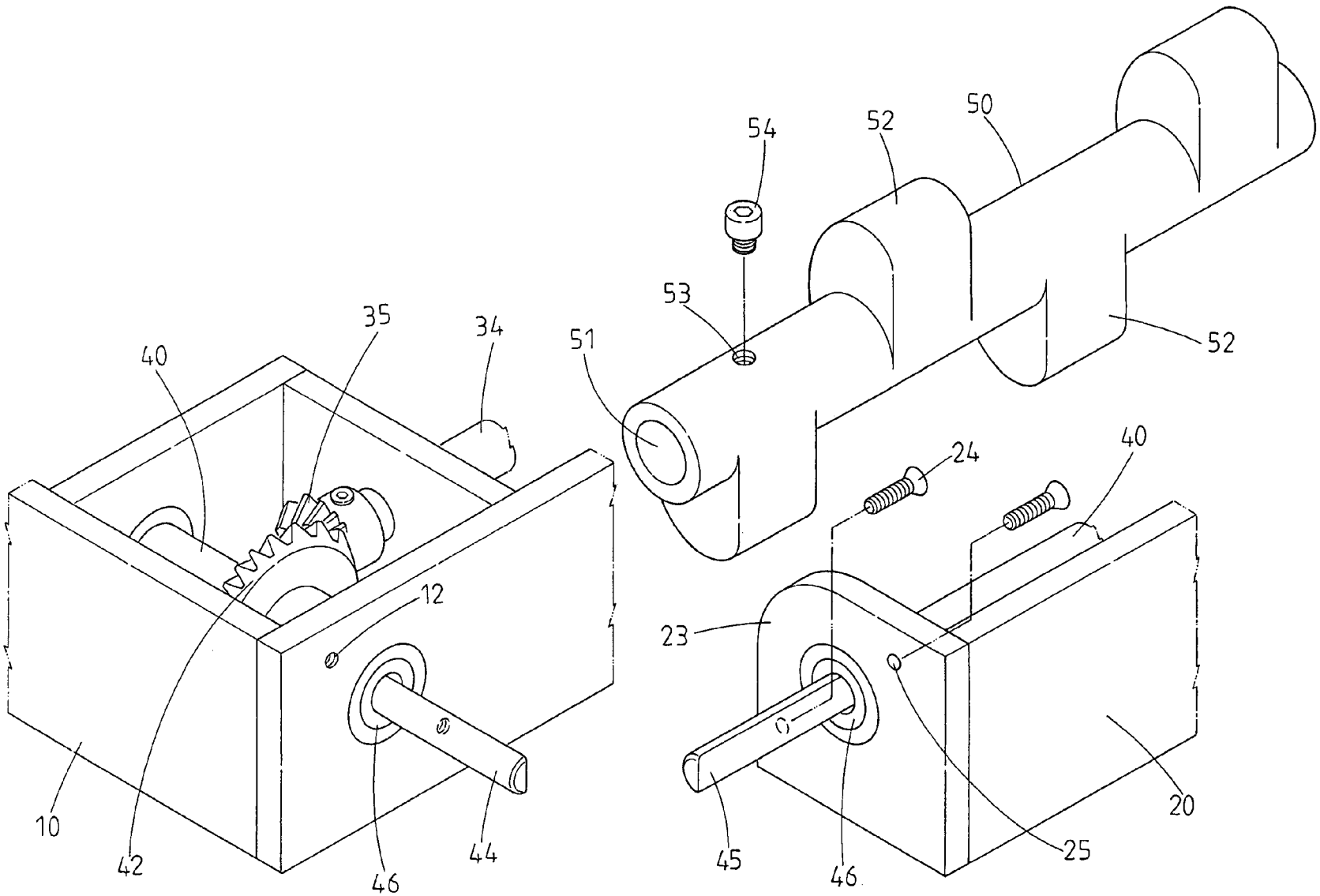
FIG. 3 is an exploded perspective view of a portion of the main structure in FIG. 2.

Referring to FIGS. 2 and 3, each longitudinal shaft 40, 41 may be comprised of two shaft halves 44 and 45. Bolts 24 are extended through through-holes 25 in the front end sections 23 of the side boards 20 and 21 into screw holes 12 of the control box 10, thereby fixing the control box 10 and the bed frame together. The longitudinal shaft 40 is rotatably supported by bearings 46 in the front and rear end sections 23 of the side board 20 whereas the longitudinal shaft 41 is rotatably supported by bearings (not labeled) in the front and rear end sections 23 of the side board 21.

In the illustrated embodiment, the flapping device comprises a plurality of flapping members 50 on each longitudinal shaft 40, 41 to turn jointly with the longitudinal shaft 40, 41. The flapping members 50 are made of plastic or rubber. Each flapping member 50 includes a central hole 51 through which an associated longitudinal shaft 40, 41 extends. A screw 54 is extended through a radial screw hole 53 (FIG. 3) to fix each flapping member 50 on the longitudinal shaft 40, 41. Each flapping member 50 further includes an eccentric protrusion 52. It is noted that two adjacent eccentric protrusions 52 on the same longitudinal shaft 40, 41 extend in opposite directions. It is further noted that two eccentric protrusions 52 that are respectively on the longitudinal shafts 40 and 41 and that are at the same longitudinal position of the bed frame extend in opposite direction, as shown in FIG. 2.

Figure 4:
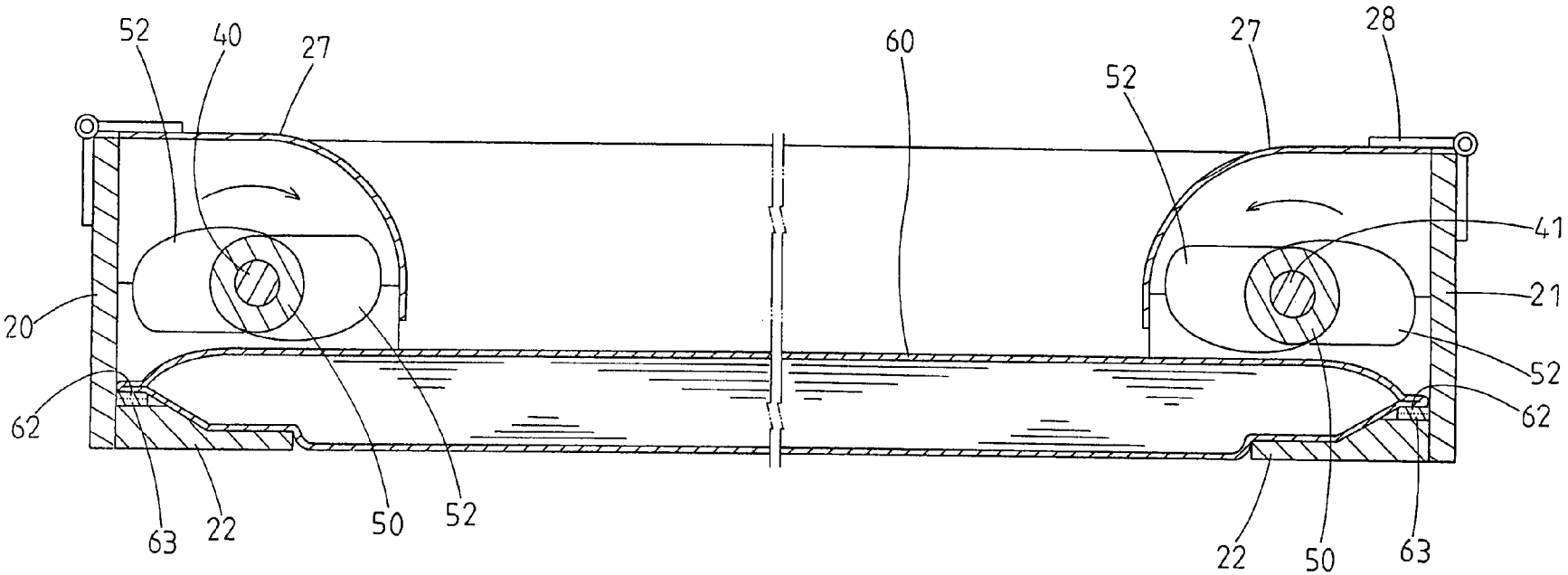
FIG. 4 is a sectional view of the water mattress in FIG. 1.

Referring to FIGS. 1 and 4, the water mattress 60 is mounted between the side boards 20 and 21, with two lateral sides of an upper face of the water mattress 60 located below the flapping members 50. Fasteners (such as hook fasteners) are provided on strips 62 for engaging with e.g., loop fasteners on strips 63 on the side boards 20 and 21. Preferably, the water mattress 60 is separated into a plurality of isolated sections 61 corresponding to the number of the flapping members 50 or of the eccentric protrusions 52 on each longitudinal shaft 40, 41.

Figure 5:
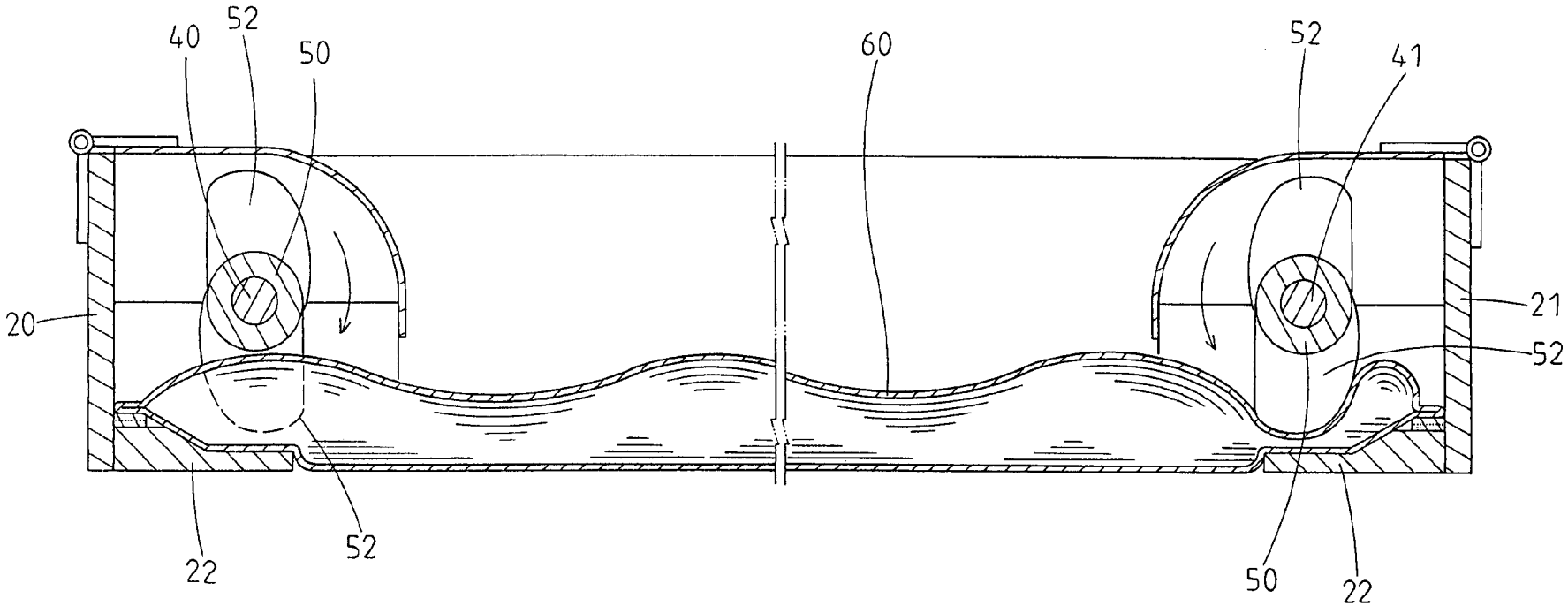
FIG. 5 is a view similar to FIG. 4, illustrating operation of a flapping device.

Referring to FIG. 4, when the flapping members 50 are moved to a horizontal position, the water mattress 60 are not flapped by the eccentric protrusions 52. Referring to FIG. 5, when the flapping members 50 are moved to the vertical position, the eccentric protrusions 52 flap the water mattress 60. Since two adjacent eccentric protrusions 52 on the same longitudinal shaft 40, 41 extend in opposite directions and since two eccentric protrusions 52 that are respectively on the longitudinal shafts 40 and 41 and that are at the same longitudinal positioning of the bed frame extend in opposite direction, repeated flapping is carried out on the water mattress 60. Water waves are created inside the water mattress 60, providing a massage effect.

Figure 6:
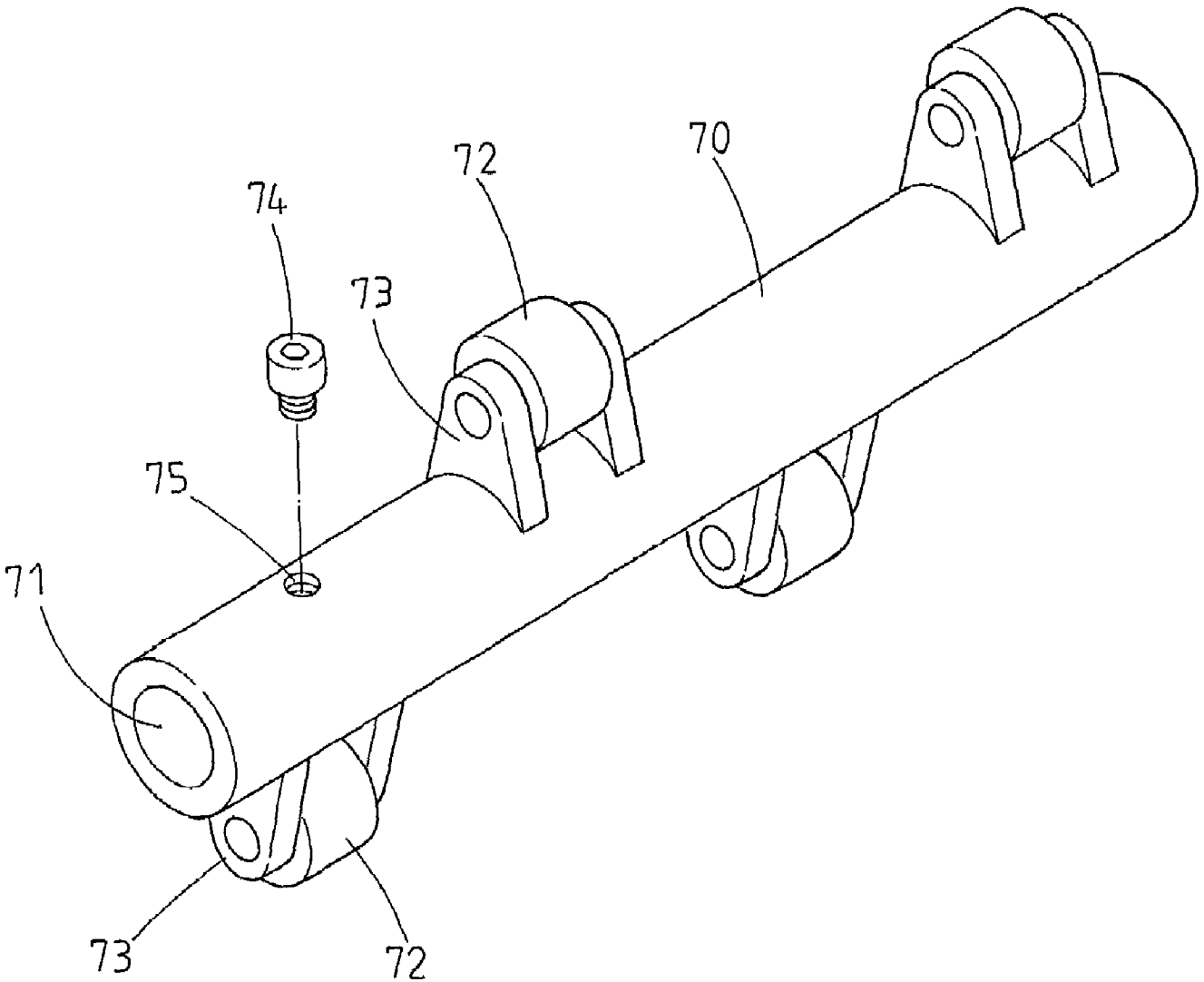
FIG. 6 is a perspective view of a modified embodiment of the flapping device.

FIG. 6 illustrates a modified embodiment of the flapping device. In this embodiment, each flapping member 70 includes a central hole 71 through which an associated longitudinal shaft 40, 41 extends. A screw 74 is extended through a radial screw hole 75 to fix each flapping member 70 on the longitudinal shaft 40, 41. A plurality of pair of supports 73 are mounted on an outer periphery of each flapping member 70, with a flapping roller 72 rotatably supported between each pair of supports 73.

Figure 7:
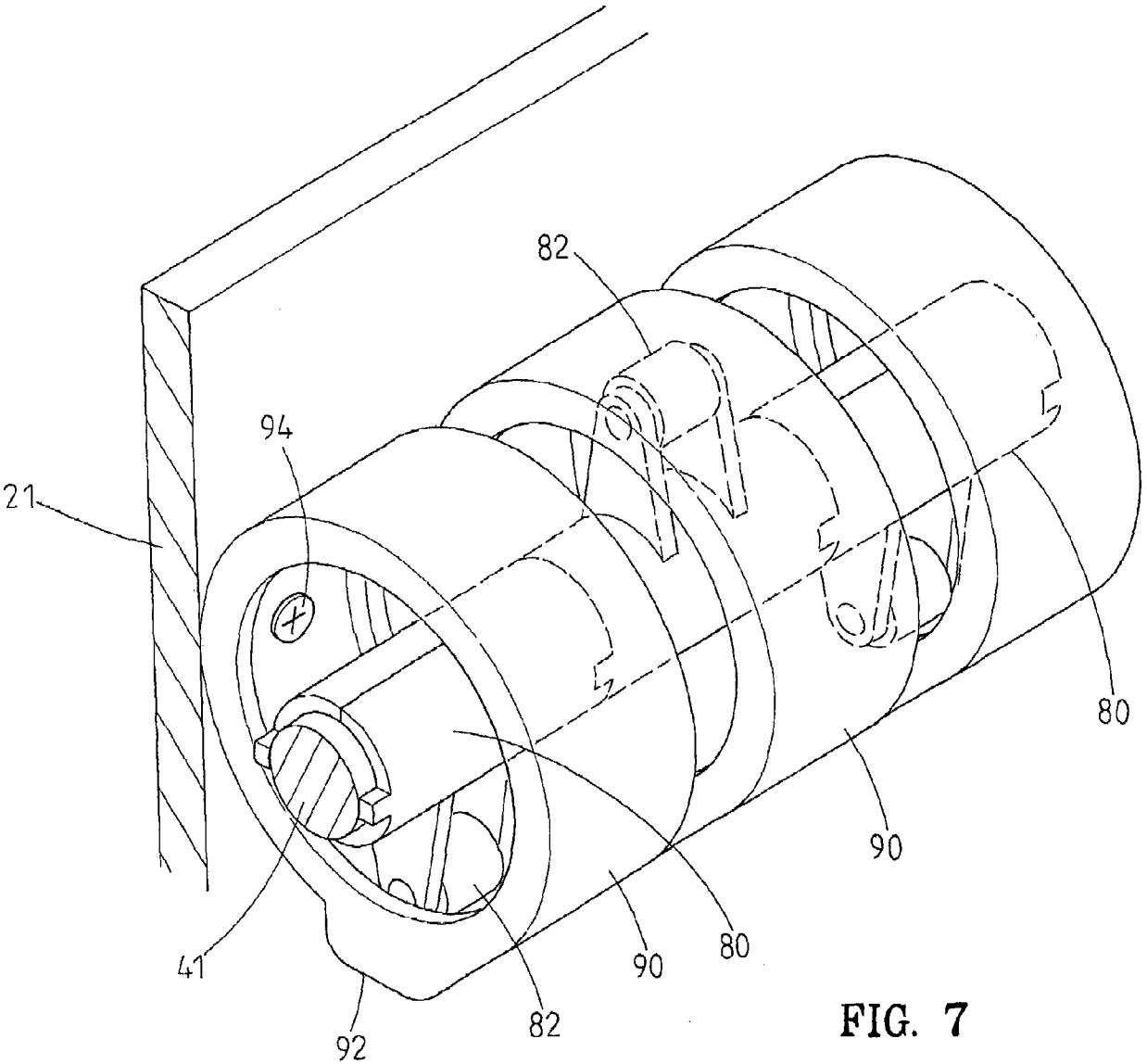
FIG. 7 is a perspective view of another modified embodiment of the flapping device.
Figure 8:
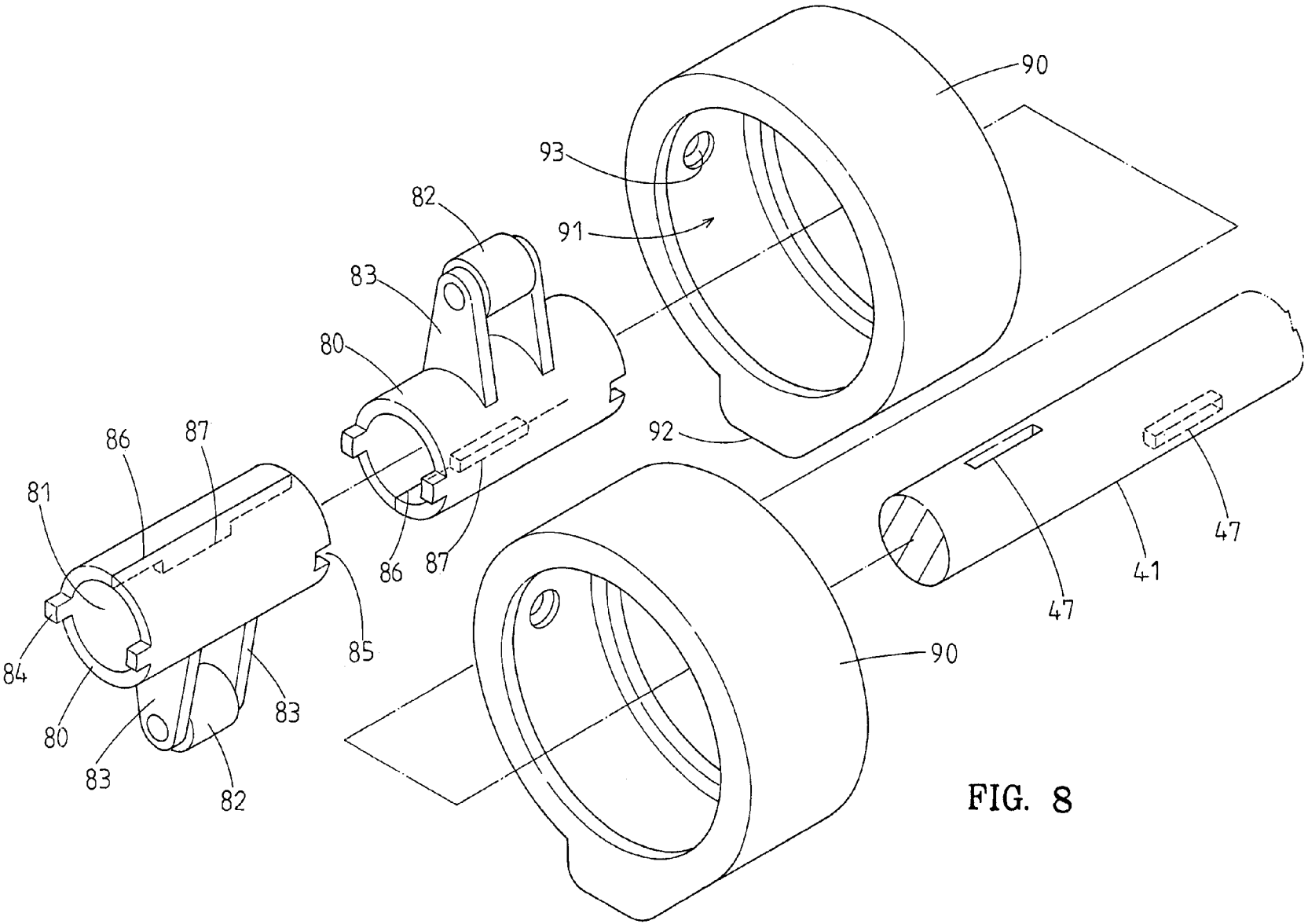
FIG. 8 is an exploded perspective view of the flapping device in FIG. 7.
Figure 9:
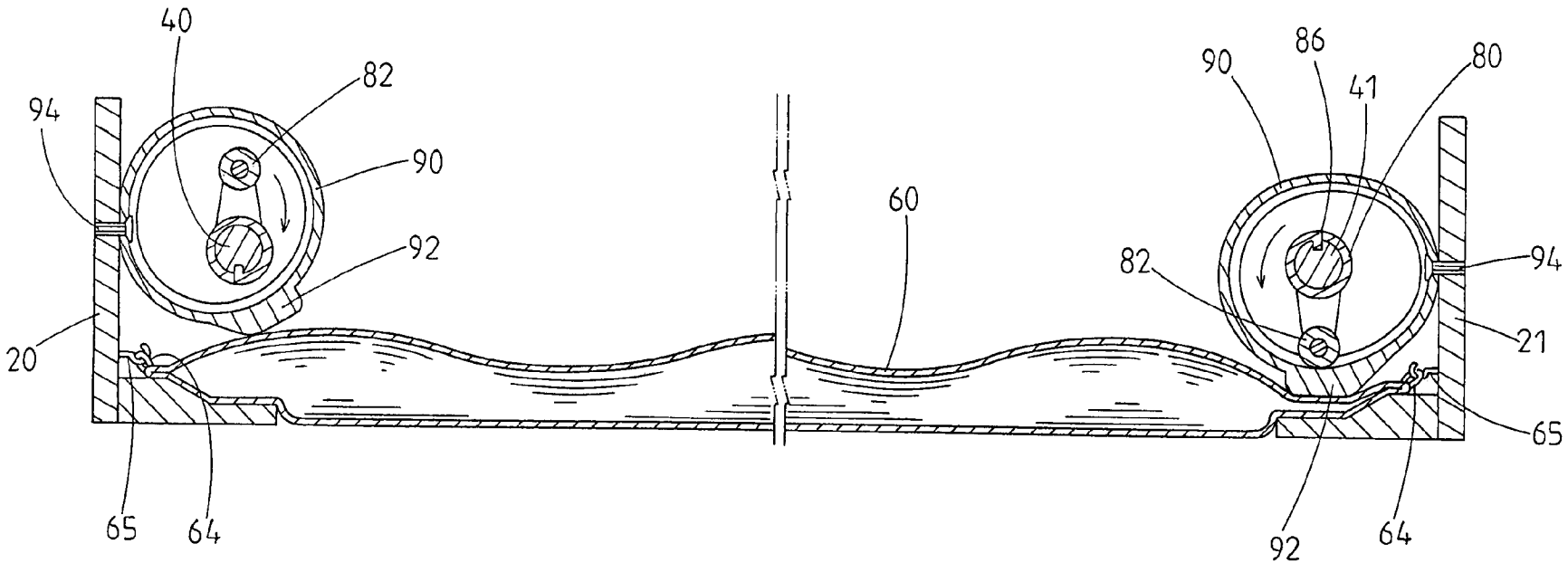
FIG. 9 is a sectional view illustration operation of the flapping device in FIG. 7.

FIGS. 7 and 8 illustrate another modified embodiment of the flapping device modified from the embodiment of FIG. 6. In this embodiment, each flapping member 80 includes a central hole 81 and a flapping roller 82 rotatably supported between a pair of supports 83. An outer ring (or pressing member) 90 is mounted around each flapping member 80 and comprises an opening 91 and an eccentric flapping section 92 on an outer periphery thereof. Each outer ring 90 further includes a radial hole 93 through which a bolt 94 extends to thereby fix the outer ring 90 to the side board 20, 21, as shown in FIG. 9. It is noted that the longitudinal shaft 40, 41 is eccentric to a longitudinal axis of each outer ring 90.

Preferably, each flapping member 80 includes engaging protrusions 84 on an end face thereof and engaging notches 85 in the other end face thereof, allowing coupling of the flapping members 80. Each flapping member 80 may include a cutting line 86, allowing the flapping member 80 to be opened to a substantially C-shaped state.

A key 87 may be formed on an inner periphery of each flapping member 80 for engaging with an associated key groove 47 in the longitudinal shaft 40, 41. Further, the water mattress 60 includes loops 64 on each lateral side thereof for engaging with hooks 65 fixed on the side boards 20 and 21. As illustrated in FIG. 9, when the longitudinal shafts 40 and 41 are driven by the motor 30, the pressing rollers 82 cause the respective outer rings 90 to turn, such that each eccentric flapping section 92 flaps the water mattress 60 intermittently.

Figure 10:
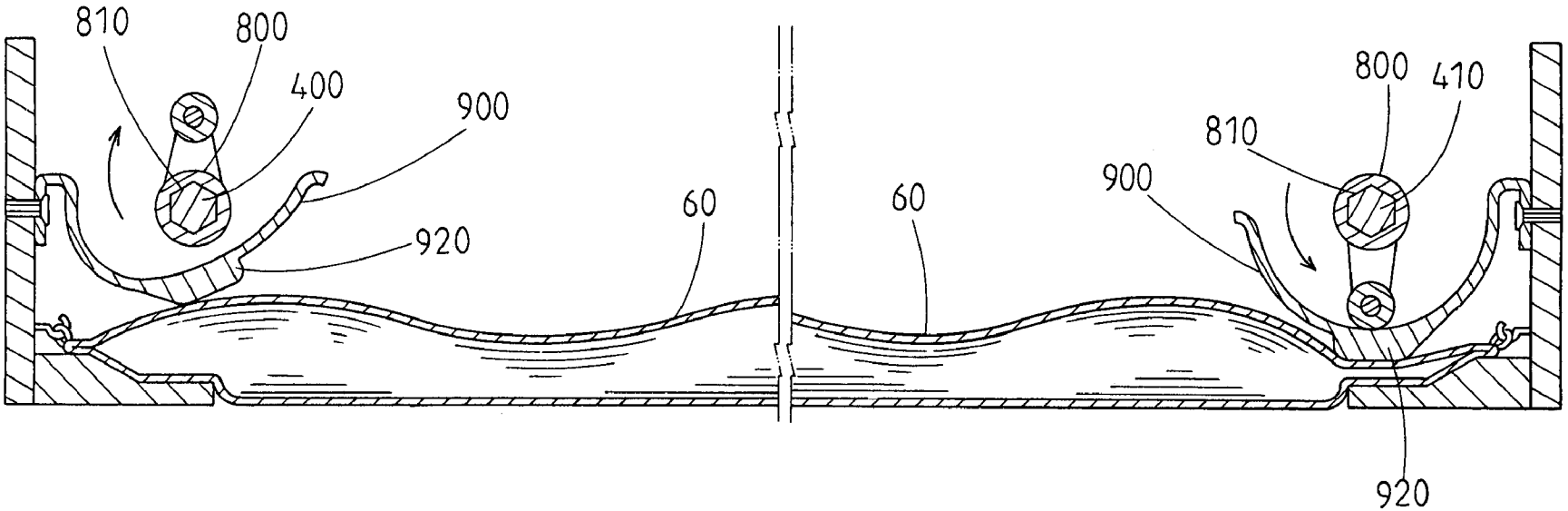
FIG. 10 is a sectional view illustrating operation of a further modified embodiment of the flapping device in FIG. 7.

FIG. 10 illustrates flapping operation of an embodiment modified from the embodiment of FIGS. 8 and 9. In this embodiment, each longitudinal shaft 400, 410 is polygonal in section, and each flapping member 800 includes a polygonal central hole 810 for securely receiving the longitudinal shaft 400, 410. A semi-circular pressing member 900 is mounted below each flapping member 800. Each semi-circular pressing member 900 includes an end fixed to the side board 20, 21 and a downwardly extending eccentric flapping section 920 for intermittently flapping the water mattress 60.

Figure 11:
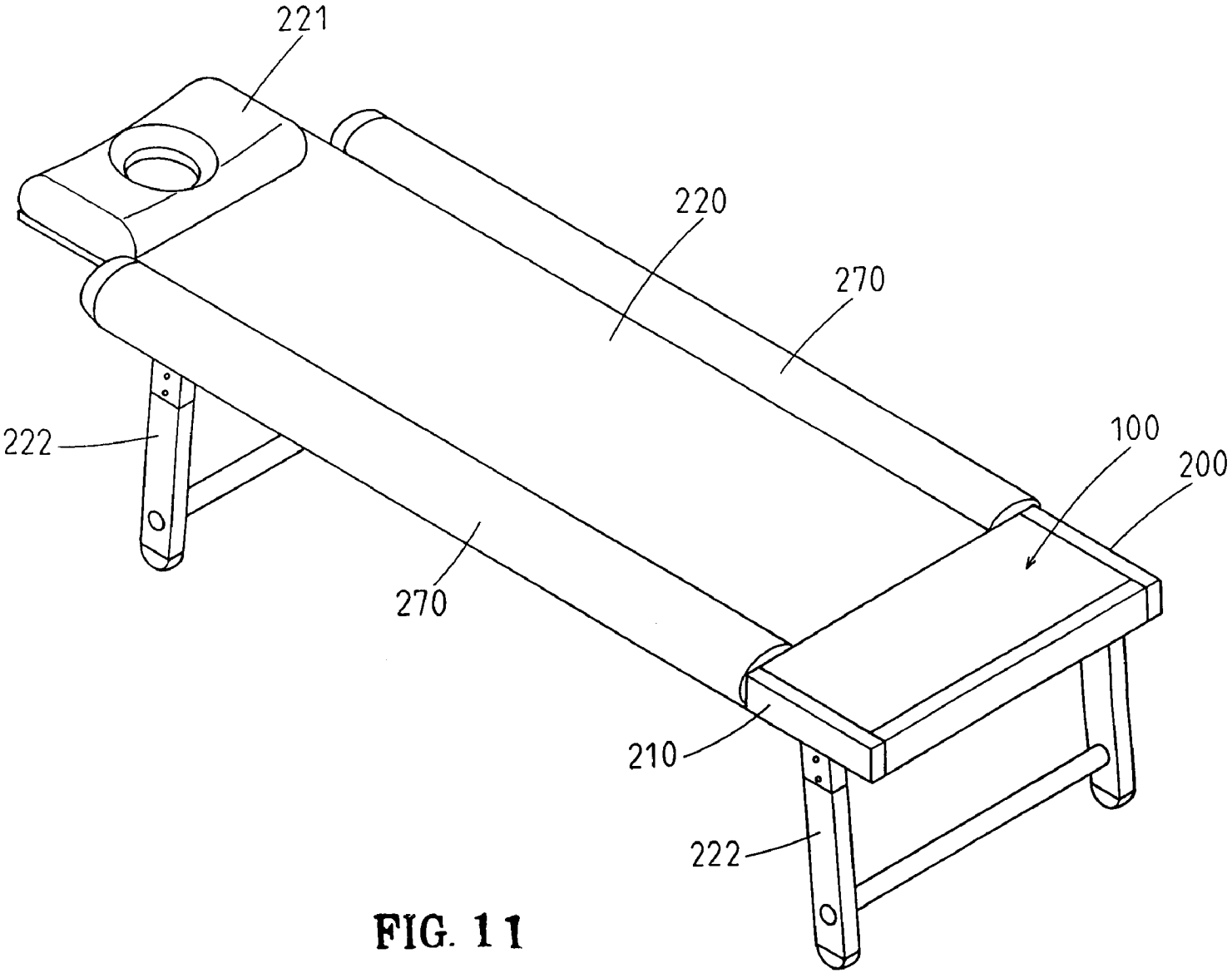
FIG. 11 is a perspective view illustrating a modified embodiment of the waterbed in accordance with the present invention.

FIG. 11 illustrates a modified embodiment of the water bed, wherein a plurality of legs 222 extend downward from each side board 200, 210 and a bottom board 220 is mounted between the side bards 200 and 210, with the control box 100 being attached to a lower end of the bottom board 200 and with a pillow 221 being attached to an upper end of the bottom board 220. An integral lid 270 may be provided to each side board 200, 210.

Thus, the user may lie on the water mattress 60 and turn on the power switch 14 to activate the motor 30. The flapping members 50, 70, 80 flap the water mattress 60 to create water waves inside the water mattress 60. The user's body such as the abdomen, arms, hips, legs, and breast can be massaged to obtain effects of exercise, fats removal, and weight losing.

Although specific embodiments have been illustrated and described, numerous modifications and variations are still possible without departing from the essence of the invention. The scope of the invention is limited by the accompanying claims.

What is claimed is:

1. A waterbed comprising:

a bed frame;

a water mattress mounted on the bed frame; and a flapping device comprising:

two longitudinal shafts rotatably supported by the bed frame; and a plurality of flapping members securely mounted on each said longitudinal shaft, said flapping members flapping the water mattress when the longitudinal shafts turn, thereby creating water waves inside the water mattress.

2. The waterbed as claimed in claim 1, wherein the bed frame comprises two side boards each having a bottom section for supporting the water mattress.

3. The waterbed as claimed in claim 2, wherein each said side board has a front end section and a rear end section, and wherein each said longitudinal shaft is rotatably extended through the front end section and the rear end section of an associated one of the side boards.

4. The waterbed as claimed in claim 1, wherein each said flapping member comprises a central hole through which an associated one of the longitudinal shafts extends.

5. The waterbed as claimed in claim 4, wherein each said flapping member comprises at least one engaging protrusion in an end face thereof, and wherein each said flapping member comprises at least one engaging notch on another end face thereof, allowing coupling of two adjacent said flapping members.

6. The waterbed as claimed in claim 1, wherein each said flapping member comprises an eccentric protrusion for flapping the water mattress.

7. The waterbed as claimed in claim 6, wherein two adjacent said eccentric protrusions on the same longitudinal shaft extend in opposite directions.

8. The waterbed as claimed in claim 6, wherein two of said eccentric protrusions that are respectively on the longitudinal shafts and that are at the same longitudinal position of the bed frame extend in opposite direction.

9. The waterbed as claimed in claim 7, wherein two of said eccentric protrusions that are respectively on the longitudinal shafts and that are at the same longitudinal position of the bed frame extend in opposite direction.

10. The waterbed as claimed in claim 1, wherein each said flapping member comprises at least one pair of supports mounted on an outer periphery thereof, a flapping roller being rotatably supported between each said at least one pair of supports.

11. The waterbed as claimed in claim 10, further comprising an outer ring mounted around and actuatable by each said flapping member, each said outer ring being fixed to the bed frame, each said outer ring including an eccentric flapping section for flapping the water mattress.

12. The waterbed as claimed in claim 1, wherein the water mattress comprises a plurality of isolated sections corresponding to the number of the flapping members on each said longitudinal shaft.

13. The waterbed as claimed in claim 1, further comprising means for driving the longitudinal shafts.

* * * * *